US006231688B1

(12) United States Patent
Ishii et al.

(10) Patent No.: US 6,231,688 B1
(45) Date of Patent: May 15, 2001

(54) COMPOSITION AND PROCESS FOR ZINC PHOSPHATE CONVERSION COATING

(75) Inventors: Hitoshi Ishii; Yasuhiko Nagashima, both of Hiratsuka (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/091,043

(22) PCT Filed: Dec. 6, 1996

(86) PCT No.: PCT/US96/19144

§ 371 Date: Jun. 8, 1998

§ 102(e) Date: Jun. 8, 1998

(87) PCT Pub. No.: WO97/20964

PCT Pub. Date: Jun. 12, 1997

(30) Foreign Application Priority Data

Dec. 6, 1995 (JP) ..... 7-318311

(51) Int. Cl.[7] ..... C23C 22/07

(52) U.S. Cl. ..... 148/259; 148/262; 252/186.42; 252/396

(58) Field of Search ..... 148/259, 262; 252/186.42, 396

(56) References Cited

U.S. PATENT DOCUMENTS

| | | | | |
|---|---|---|---|---|
| 4,233,087 | * | 11/1980 | Cooke | 148/262 |
| 4,517,030 | | 5/1985 | Yamamoto et al. . | |
| 5,268,041 | * | 12/1993 | Gehmecker et al. | 148/260 |
| 5,312,492 | * | 5/1994 | Riesop et al. | 148/260 |

FOREIGN PATENT DOCUMENTS

| | | | |
|---|---|---|---|
| 905853 | * | 9/1962 | (GB) . |
| 62-009190 | | 2/1987 | (JP) . |
| 63-018084 | | 1/1988 | (JP) . |

* cited by examiner

*Primary Examiner*—John Sheehan
*Assistant Examiner*—Andrew L. Oltmans
(74) *Attorney, Agent, or Firm*—Wayne C. Jaeschke; Stephen D. Harper; Norvell E. Wisdom, Jr.

(57) ABSTRACT

A zinc phosphate-type conversion film having microfine-sized crystals is formed on metal surfaces using a conversion treatment bath that contains zinc ions and phosphate ions along with 50 to 1500 ppm of an organoperoxide conversion accelerator, and optionally surfactant. Surface-conditioning treatments can be omitted from this method. The presence of the surfactant makes possible simultaneous execution of surface cleaning and conversion treatment

20 Claims, No Drawings

COMPOSITION AND PROCESS FOR ZINC PHOSPHATE CONVERSION COATING

DESCRIPTION

1. Field of the Invention

The present invention relates to zinc phosphate-based conversion coating or treatment compositions for application to metals) for example, steels and zinc-plated steels, and to methods for the zinc phosphate-based conversion treatment or coating of metals. More particularly, this invention relates to a zinc phosphate-based conversion treatment composition, often hereinafter called a "bath" for brevity, even when used by some method other than immersion, and method that can uniformly coat metals with a fine, dense zinc phosphate-type conversion coating that contains extremely small conversion crystals and that, based on the presence of said microfine crystals, can improve the adherence of the zinc phosphate-type conversion film to paint films.

2. Description of Related Art

At present, a zinc phosphate-based conversion treatment is executed as a pretreatment on various metals when the metal is to be painted or subjected to cold working. This pretreatment is carried out in the former case in order to improve the post-painting corrosion resistance and the paint film adherence and in the latter case in order to improve lubrication during cold working.

The conversion treatment baths used in zinc phosphate-based conversion treatments are essentially acidic aqueous solutions that contain zinc ions, phosphate ions, and oxidizer. Nitrite salts, chlorate salts, hydrogen peroxide, organic nitro compounds, hydroxylamine, and the like, are usually considered for use as the oxidizer. These oxidizers function to accelerate the conversion reactions and so are generally called conversion accelerators. While a nitrate salt may be present in the conversion treatment bath, nitrate salts do not exhibit an oxidizing function in zinc phosphate-based conversion treatment baths and so are distinct from conversion accelerators.

In the case of the conversion treatment of ferriferous metals, one role of the conversion accelerator in zinc phosphate-based conversion treatment is to oxidize the divalent iron ions eluted into the bath to trivalent iron ions. The conversion reactions are inhibited, for example, by the accumulation of divalent iron ions during the continuous conversion treatment of ferriferous metals, so the role of the conversion accelerator in preventing accumulation of the divalent iron ions is extremely important.

However, the known conversion accelerators are each associated with problems that must be solved. For example, in the case of the nitrite salts, which are at present the most widely used conversion accelerators, these are unstable in the acidic region and are thus consumed by spontaneous decomposition even when no conversion treatment is being run and the bath is merely stored. This requires continual make up of the consumed amount in order to maintain a constant concentration.

Furthermore, as is known some of the nitrite salt is converted to $NO_x$ during the spontaneous decomposition or the intended oxidation activity, and this $NO_x$ diffuses into the atmosphere as a pollutant.

In the case of chlorate salt conversion accelerators, chloride ions are produced during conversion treatment as a decomposition product and accumulate in the conversion treatment bath. The corrosion resistance of the metal suffers a drastic decline when even a trace amount of the chloride ions in the conversion treatment bath remains present on the surface of the treated metal. Moreover, although chlorate salts are generally used in combination with another conversion accelerator, such as a nitrite salt, the use of a chlorate salt by itself results in a substantial reduction in the conversion reaction rate.

The use of hydrogen peroxide as a conversion accelerator is associated with problems of stability in the conversion treatment bath, and hydrogen peroxide is readily decomposed by dissolved oxygen in the conversion bath. In addition, hydrogen peroxide has a narrow optimal concentration range in conversion treatment, which makes management of the conversion treatment bath quite difficult. When the dissolved hydrogen peroxide concentration is too high, a poorly adherent powder-like conversion film is deposited on the metal surface.

Problems also occur with the use of nitrogenous organic compounds such as organic nitro compounds (e.g., nitroguanine, sodium meta-nitrobenzene sulfonate, etc.) as a conversion accelerator. For example, in the case of nitroguanine, this compound has a low water solubility and thus cannot be formulated as a concentrate for addition to the conversion treatment bath. Moreover, it has a weak oxidizing activity for divalent iron ions and so provides poor control of the divalent iron ions concentration in the conversion bath. Sodium meta-nitrobenzene sulfonate by itself has a poor conversion activity and must generally be used in combination with another stronger conversion accelerator. Its concentration management also requires large-scale measurement instrumentation, such as an ion chromatograph. In addition, the accumulation of these organic nitro compounds and their decomposition products in the conversion treatment bath causes an increase in the COD of the conversion treatment effluent, which has a negative effect on the environment.

With regard to the use of a hydroxylamine compound as a nitrogenous organic conversion accelerator, such a compound must, for best results, be added to the conversion treatment bath in concentrations of at least 1,000 ppm, which causes a large, uneconomical consumption of the conversion accelerator.

The use of chromic acid and permanganate salts as a conversion accelerator for zinc phosphate-based conversion treatment baths has been investigated (Norio Sato, et al., Boshoku Gijutsu [English title: Corrosion Engineering], Volume 15, No. 5 (1966)). These authors reported that the formation of conversion coatings was not observed at concentrations of 5 or 10 millimoles per liter.

Many of the already known conversion accelerators as described above are nitrogenous compounds. These nitrogenous compounds are refractory to removal by chemical wastewater treatment methods and must be removed by microbiological treatments. However, microbiological treatments have trouble removing high concentrations of nitrogenous compounds and cannot completely remove even low concentrations. Nitrogenous compounds have recently been one factor contributing to the eutrophication of bodies of water and have therefore been targeted for increasingly stringent discharge regulations. These environmental considerations have created demand for the development of a nitrogenous compound-free zinc phosphate-based conversion treatment bath.

At present, zinc phosphate-based conversion treatments and chromate treatments are widely used to provide underpaint coatings for the purpose of improving the post-painting corrosion resistance and paint film adherence of various metals. Metal substrates of iron and composite materials comprising combinations of different materials are primarily subjected to zinc phosphate-based conversion treatments due to the difficulties encountered in the chromate treatment of these types of substrates.

The size of the crystals in the coatings afforded by zinc phosphate-based conversion treatment generally undergo large variations as a function of the treatment conditions. Thick coatings of coarse crystals are satisfactory when the goal is rust prevention or cold working. However, such coatings do not afford a satisfactory paint film adherence when they are subsequently painted, and the zinc phosphate-based conversion films employed as underpaint coatings must in fact be thin films of uniform, fine, and dense film crystals.

Two methods are known for obtaining thin zinc phosphate-type conversion films. One method consists of terminating the film deposition reactions during the course of these reactions by interrupting contact with the conversion bath. This method results in incomplete deposition of the conversion film and thus in incomplete coverage of the substrate metal. As a result, not only can rusting occur on the substrate metal during post-conversion steps such as the water rinse and drying, but the post-painting corrosion resistance often will also be unsatisfactory.

The other method consists of generating microfine sizes for the film crystals. In this method, the film deposition reactions end with the coating in a thin film form. As a result, the completed conversion film entirely covers the substrate metal and this method is thus able to provide both a satisfactory paint film adherence and post-painting corrosion resistance.

The above-described zinc phosphate-based conversion treatment technologies are mainly implemented by immersion and spraying. Immersion technologies not only do not provide microfine film crystals, but usually require lengthy conversion treatment times when the treatment temperature is not at least 55° C. Spray treatment, on the other hand, does provide film crystals that are somewhat finer sized than in immersion treatment, but which are still not at a level that provides a satisfactory painting performance. And again, treatment temperatures of at least 55° C. are required in order to carry out treatment in a relatively short time.

A titanium colloid surface-conditioning treatment must usually be applied to the metal surface immediately prior to conversion treatment in order to obtain (a) fine-crystal formation in the coating and (b) a reduction in the treatment temperature to 50° C. and below. This surface-conditioning treatment activates the surface of the metal work with the result that, regardless of the use of immersion or spraying, the treatment temperature can be lowered, the treatment time can be shortened, and a fine-sized crystalline film can be formed that provides an entirely satisfactory painting performance. However, management of the surface conditioner treatment bath is complicated and this treatment also requires additional facilities and an expansion of the treatment space. These considerations have quite recently strengthened the demand for a conversion accelerator that can provide a good-quality conversion film on metal surfaces even without the execution of a surface-conditioning step.

Also, the titanium colloid dispersed in the surface-conditioning treatment bath aggregates with elapsed time after bath preparation, leading to a timewise decline in the surface-conditioning activity. Japanese Patent Publication [Kokoku] Number Sho 62-9190 [9,190/1987] teaches management of the $Mg/P_2O_7$ ratio in the surface-conditioning treatment bath in order to increase the stability of the titanium colloid, while Japanese Patent Application Laid Open [Kokai or Unexamined] Number Sho 63-18084 [18,084/1988] discloses addition to the surface-conditioning treatment bath of an organic material as a stabilizer for the titanium colloid. Each of these methods, however, suffers from inadequate effects, with the result that in practice aged bath must be discharged and freshly prepared bath must be supplied on a continuous basis in order to cope with the decline in activity. This preparation and management of the surface-conditioning treatment bath is complex and labor intensive and entails a major economic burden due to its heavy reagent consumption. And of course, since treatment facilities are required in order to implement the surface-conditioning treatment, this raises such issues as maintenance of the facilities and an expansion of the treatment space.

As a consequence of the various issues discussed above, there has recently been a strengthening in demand for the development of a surface treatment method that can omit the problematic titanium colloid surface-conditioning treatment while still being able to equip the metal surface with the uniform, fine, dense, and thin conversion films that are optimal as underpaint coatings.

A general example of the treatment method used to form a zinc phosphate-type conversion film on metals comprises the execution of the following processes in the given sequence: (1) alkaline degreasing, (2) water rinse, (3) conversion, (4) water rinse, and (5) drain and dry. When the film will be used as an underpaint coating, the conversion process (3) is preceded by a surface-conditioning step using a titanium colloid treatment bath for the purpose of generating uniform, fine, and dense conversion film crystals.

The first drawback to the prior-art surface treatment technologies described above is that they use a large number of process steps, thus making the overall process quite lengthy. As a result, the necessary treatment facilities are large and take up substantial space. While the surface treatment methods described above are structured from 5 or 6 step processes, the alkaline degreasing step and water rinse step are themselves frequently implemented as multistage treatments in order to improve the cleaning efficiency. This raises equipment costs even more and in addition causes lower productivity, because even longer times are required to complete the overall treatment process.

A second drawback to the prior-art technologies as described above is that they require the management of a large number of parameters. As examples, in the alkaline degreasing step the alkalinity (total alkalinity, free alkalinity) in the degreasing bath must be managed, while in the conversion step the acid concentration in the treatment bath (total acidity, free acidity) must be managed. This amplification of the parameters under management increases the operating overhead. At the same time, the cost burden is raised by reagent consumption in the separate process steps. Finally, the storage stability of a titanium colloid dispersion is by no means guaranteed, and it requires appropriate management and periodic disposal and replenishment.

One method that can be considered for solving these two drawbacks is the execution of the steps from alkaline degreasing to conversion in a single process step through the use of a surfactant-containing zinc phosphate-based conversion bath that combines degreasing and conversion. However, when degreasing and conversion are run at the same time, the conversion reactions initiate sequentially from those regions of the metal work that have been cleaned. This creates a strong tendency for the quality and appearance of the resulting conversion film to be nonuniform.

Another possibility would be to add the surface conditioner to the conversion treatment bath in expectation of producing a surface-conditioning effect on the metal during treatment in the conversion bath. In this case, however, a surface-conditioning effect must be completely ruled out, because the titanium colloid main ingredient is unstable in the acid region. Thus, not only will the combined use of surface conditioner and conversion bath not yield microfine-sized film crystals, through a retardation of the film deposition rate it will also lead to an additional emphasizing of inhomogeneities in the appearance of the conversion film.

In sum, then, there is strong demand for a contraction of the treatment process as currently practiced, a reduction in equipment and reagent costs, and a simplification in treatment bath management. However, this demand has in actuality remained unsatisfied to date due to the high technical barriers involved in meeting it.

OBJECTS OF THE INVENTION

The present invention provides a zinc phosphate-based conversion treatment bath and method for application to metals that can deposit uniform, fine, and dense zinc phosphate-type conversion films on the surface of metal substrates and that can induce a microfine-sizing of the conversion film crystals.

In addition, the present invention provides a zinc phosphate-based conversion treatment bath and treatment method that—even without the execution on the metal surface of surface conditioning with a surface conditioner—can deposit thereon a uniform, fine, and dense zinc phosphate-type conversion film that contains microfine crystals that are highly adherent to paint films and that is effective as an underpaint layer (undercoat) for paint films.

SUMMARY OF THE INVENTION

The aforesaid objects are achieved by a zinc phosphate-based conversion treatment bath and treatment method according to the present invention as described below. A zinc phosphate-based conversion treatment bath according to the present invention for application to metals characteristically contains zinc ions and phosphate ions as its main components and also contains 50 to 1500 parts per million by weight (hereinafter usually abbreviated as "ppm") of conversion accelerator consisting of at least one organoperoxide.

The total content of rid compounds in the zinc phosphate-based conversion treatment bath according to the present invention is preferably limited to 0 to 200 ppm, measured as its stoichiometric equivalent as nitrogen. The said organoperoxide is preferably water soluble and preferably has a peroxy structure or percarboxyl structure. In addition, the subject organoperoxide is preferably selected from ethyl hydroperoxide, isopropyl hydroperoxide, tert-butyl hydroperoxide, tert-hexyl hydroperoxide, diethyl peroxide, di-tert-butyl peroxide, acetylacetone peroxide, cumene hydroperoxide, tert-butylperoxymaleic acid, peracetic acid, monoperphthalic acid, and persuccinic acid.

A zinc phosphate-based conversion treatment bath according to the present invention may also contain surfactant.

The zinc phosphate-based conversion treatment method according to the present invention for application to metals is characterized by the formation of a zinc phosphate-type conversion film on the surface of a metal by bringing the metal surface into contact with a conversion treatment bath that contains zinc ions and phosphate ions as its main components and that also contains 50 to 1500 ppm of conversion accelerator consisting of at least I organoperoxide.

The total content of nitrogenous compounds in the said treatment bath used in the zinc phosphate-based conversion treatment method according to the present invention is preferably limited to 0 to 200 ppm as the nitrogen content. The said conversion accelerator is preferably water soluble and preferably has a peroxy structure or percarboxyl structure. In addition, the subject conversion bath preferably has a pH from 20 to 4.0 and preferably is kept at a temperature of 25° C. to 50° C. The surface of the metal may also be subjected to a cleaning step immediately before the subject conversion treatment.

A conversion treatment bath used in the zinc phosphate-based conversion treatment method according to the present invention may also contain surfactant in order to simultaneously effect cleaning and conversion coating of the metal surface. When a surfactant is used, its concentration in the conversion treatment bath is preferably from 0.5 to 5 g/L.

DETAILS OF THE INVENTION AND ITS PREFERRED EMBODIMENTS

It has been discovered that (1) an organoperoxide conversion accelerator did not require the co-use of another prior-art conversion accelerator or a nitric acid compound, which made possible the formulation of a nitrogenous compound-free conversion bath; (2) even without the execution of a surface-conditioning treatment, a uniform, fine, and dense zinc phosphate-type conversion film could be formed on metal surfaces when organoperoxide was used as the conversion accelerator; and (3) a good performing zinc phosphate-type conversion film can be formed on metals without narrow restrictions originating with the treatment temperature or zinc concentration of the treatment bath. The present invention was achieved based on these discoveries.

As stated above, the total content of nitrogenous compounds in the conversion bath according to the present invention is limited to 0 to 200 ppm, preferably to 0 to 100 ppm, more preferably to 0 to 50 ppm, and even more preferably to 0 to 20 ppm, in each case measured as its stoichiometric equivalent as nitrogen.

The most preferred range for the zinc ions content in a conversion bath according to the present invention will vary as a function of the particular application of the conversion film. The preferred zinc ions content in the conversion bath is from 0.5 to 15 grams per liter, hereinafter usually abbreviated as "g/L".

For example, when the conversion bath according to the present invention is used to provide an underpaint coating on the metal, the preferred conversion film weight is from about 0.5 to 10.0 grams per square meter of surface treated with the bath, hereinafter usually abbreviated as "$g/m^2$". Due to this, the preferred concentration range for the zinc ions in the conversion bath for this application will be from 0.5 to 5.0 g/L. When the zinc ions concentration is less than 0.5 g/L, the resulting zinc phosphate-type conversion film will have a reduced coverage ratio and the post-painting paint film adherence and post-painting corrosion resistance usually will be unsatisfactory. At above 5.0 g/L, the post-painting paint film adherence in particular is reduced due to a coarsening of the film crystals.

When, on the other hand, the conversion bath will be used for cold working of the metal treated with i, a thick film with a film weight of about 5.0 to 15.0 g/m$^2$ is preferably laid down in order to provide a conversion film capable of following the plastic deformation of the workpiece. In this case, the preferred zinc ions concentration range for the conversion bath will be from 5.0 to 15.0 g/L. At zinc ions concentrations below 5.0 g/L, it can be difficult to obtain film weights as specified above for this application. The coating weight no longer increases at above 15.0 g/L, which makes such concentrations uneconomical.

The zinc ions needed in a composition according to the invention can be provided by dissolving zinc oxide or zinc hydroxide in the acid component in the conversion bath, or by dissolving a water-soluble salt, for example, zinc phosphate or sulfate in the conversion bath.

The phosphate ions concentration in the conversion bath according to the present invention is preferably from 5.0 to 30.0 g/L. The formation of a normal conversion film becomes problematic at values below 5.0 g/L. The effects of the phosphate ions no longer increase at above 30.0 g/L, which makes such concentrations uneconomical. The phosphate ions can be generated by the addition of phosphoric acid or its aqueous solution to the conversion bath or by dissolution in the conversion bath of a salt of phosphoric acid, such as the sodium, potassium, magnesium, or zinc salt.

A zinc phosphate-based conversion treatment bath according to the present invention preferably is an acidic aqueous solution with a pH value from 2.0 to 4.0 and more preferably about 2.5 to 3.5. In this pH region, orthophosphoric acid ($H_3PO_4$) has an equilibrium relationship with dihydrogen phosphate ions ($H_2PO_4^-$), hydrogen phosphate ions ($HPO_4^{-2}$), and phosphate ions ($PO_4^{3-}$), and the stoichiometric equivalent as phosphate ions of all of these species, along with any of the condensed phosphoric acids and their salts in which phosphorus has its +5 valence state, are considered to be part of the "phosphate ions" content as used herein, irrespective of whatever degree of ionization may actually exist in the composition.

A conversion bath according to the present invention contains conversion accelerator consisting of at least one selection from the organoperoxides. This organoperoxide is preferably water soluble and is preferably selected from compounds having a peroxy structure or percarboxyl structure. The organoperoxide used by the present invention encompasses aromatic peroxides, cyclic aliphatic peroxides, and aliphatic peroxides, and aliphatic peroxides having 1 to 7 carbon atoms are preferred. Organoperoxides bearing long-chain alkyl and aromatic peroxides can be inadequately soluble in water and thus can have an unsatisfactory conversion accelerating activity.

Organoperoxides effective as a conversion accelerator are preferably selected from those with a simple peroxy structure, such as ethyl hydroperoxide, isopropyl hydroperoxide, tert-butyl hydroperoxide, tert-hexyl hydroperoxide, diethyl peroxide, di-tert-butyl peroxide, acetylacetone peroxide, cumene hydroperoxide, and tert-butylperoxymaleic acid, and those with a percarboxyl structure, such as peracetic acid, monoperphthalic acid, and persuccinic acid.

When the organoperoxide has a low solubility in the conversion bath, the poorly soluble compound can be solubilized by the addition to the treatment bath of a small amount of water-soluble organic solvent, for example, tert-butyl alcohol or isopropyl alcohol.

A working conversion treatment bath according to the present invention as described above preferably contains the conversion accelerator at a concentration of 50 to 1,500 ppm and preferably 80 to 1,200 ppm. The conversion accelerating activity will usually be unsatisfactory when the conversion accelerator concentration is less than 50 ppm. The conversion accelerating activity no longer increases at conversion accelerator concentrations above 1,500 ppm, which makes such concentrations uneconomical.

Since the conversion treatment bath according to the present invention also has the ability to microfine-size the deposited zinc phosphate-type crystals, it can produce a uniform, fine, and dense zinc phosphate-type conversion film even in the absence of any preceding surface conditioning treatment for the purpose of microfine-sizing the film crystals. Moreover, since the conversion treatment bath according to the present invention need not contain nitric acid, nitrous acid, an organic nitro compound, etc., it can be formulated completely free of nitrogenous compounds. In this case, effluent treatment will not require a process for treating nitrogenous compounds. Although the addition of nitrogenous compounds to the conversion bath according to the present invention is not precluded, the nitrogen concentration is preferably limited as discussed above to 0 to 200 ppm.

In addition to zinc ions, a zinc phosphate-based conversion bath according to the present invention may also contain supplementary metal ions. These supplementary metal ions can function as an etchant in order to induce a uniform etch of the surface of the metal substrate, or, in the case of application as an underpaint coating, they can function to improve the painting performance.

Such non-zinc supplementary metal ions can be nickel ions, manganese ions, cobalt ions, iron ions, magnesium ions, calcium ions, and so forth. These supplementary metal ions can be provided in a composition according to the invention by dissolving their oxides, hydroxides, carbonates, sulfates, phosphates, etc., in the treatment bath.

Supplementary metal ions can be added to the conversion bath according to the present invention at 100 to 3,000 ppm and preferably at 200 to 2,000 ppm.

When ferriferous material is treated with a conversion bath according to the present invention, trivalent iron ions will dissolve from the metal into the treatment bath and will accumulate at levels of 10 to 50 ppm. The accumulation of this amount of trivalent iron ions does not have a negative influence on the effects of the treatment bath and method according to the present invention. Accordingly, trivalent iron ions may be added to or may be present in the treatment bath within this range prior to conversion treatment.

Depending on the particular requirements, a conversion bath according to the present invention may contain fluoride ions or fluorine-containing anions, for example, complex fluoride ions such as fluosilicate ions or fluozirconate ions. Fluorine-containing anions can be provided in a composition according to this invention by dissolving a fluorine-containing compound in the conversion bath, for example, hydrofluoric acid, fluosilicic acid, fluozirconic acid, fluotitanic acid, and their metal salts (sodium salts, potassium salts, magnesium salts).

A method according to the present invention includes a process in which the surface of the metal is brought into contact with the zinc phosphate-based conversion treatment bath. When the metal already has a clean surface, the zinc phosphate-based conversion treatment can be directly executed on the clean metal by the method according to the present invention. However, when the surface of the metal work is contaminated with microscopic metal particles, dust, or grease, the contaminants should preferably be removed from the metal surface prior to the conversion treatment, by executing a cleaning treatment on the metal surface, preferably a cleaning treatment using a waterborne alkaline degreasing bath, waterborne cleaning emulsion, or cleaning solvent. When a waterborne cleaning bath is used, any of it remaining on the surface is preferably removed by rinsing the metal surface with water.

In general, prior to conversion treatment the surface of the metal is degreased with an alkaline degreaser and then rinsed with water. In addition, after the conversion treatment the conversion film is rinsed with water and then dried. Both the degreasing and rinse processes may be implemented as multistage processes. When the conversion film is to be used as an underpaint coating, the final rinse preferably uses deionized water.

In addition, when the conversion film is placed on the metal surface to function as an undercoating for paint films, a surface-conditioning treatment using a titanium compound colloid-containing surface conditioner is preferably executed on the metal surface immediately prior to the conversion treatment. However, this surface-conditioning treatment can be omitted in the method according to the present invention.

The conversion treated surface of the metal is rinsed with water, dried as necessary, and then painted.

When the conversion treatment bath according to the present invention will be used to lay down a conversion film in order to support cold working of the metal, the degreasing and water rinse steps are preferably followed by an acid rinse of the metal in order to remove scale from the metal surface.

When the conversion film is to be used to support cold working, the film surface is preferably lubricated with a lubricant, for example, a soap, in order to improve the lubricating properties of the conversion film.

Contact between the metal being treated and the conversion treatment composition in a method according to the present invention is generally effected by, for example, immersion, spraying, or a combination thereof. When the conversion treatment is being run in order to provide an undercoat for paint films, the treatment is preferably run for 0.5 to 5 minutes at a temperature from ambient temperature to 60° C. When the conversion treatment is being run on metal that will be cold worked, the treatment temperature is preferably from 50° C. to 90° C. and the treatment time is preferably from 1 to 15 minutes. The above-described treatment conditions will yield the desired conversion films.

Because the organoperoxide (conversion accelerator) in the conversion bath according to the present invention functions as an oxidizer, its reaction and/or decomposition products will accumulate in the treatment bath. For example, alcohol is produced by the reaction and/or decomposition of hydroperoxide, while alcohol and carboxylic acid are produced by the reaction and/or decomposition of peroxyester. Carboxylic acid is also produced by the reaction and/or decomposition of percarboxylic acid. The accumulation of these reaction and/or decomposition products does not exercise a negative influence on the treatment bath and method according to the present invention. As a consequence, prior to conversion treatment the reaction and/or decomposition products of the organoperoxide may be present in the treatment bath according to the present invention, or may even be added to the bath, in either case without normally causing any problems.

The type, form, and dimensions of metal substrates that may be subjected to the method according to the present invention are entirely unrestricted.

In specific terms, the method according to the present invention can be applied to various ferriferous materials, for example, steel sheet and steel sheet plated with zinciferous metal, and to various aluminiferous metals, for example, aluminum and aluminum alloys such as aluminum-magnesium alloys and aluminum-silicon alloys.

A zinc phosphate-based conversion treatment bath according to the present invention may as necessary also contain surfactant for cleaning the surface of the metal.

The metal surface can be cleaned when surfactant is present in the conversion bath and, concurrently with this, can be covered with a zinc phosphate conversion film. The surface of the metal may be soiled in this case, and there are absolutely no restrictions on these contaminants as long as they can be removed by the surfactant-containing conversion bath. These contaminants include oils and greases, for example, grease, antirust oils, and press oils (these may be contaminated with dust); microfine metal particles; and other material. The amount of contaminant is also not narrowly restricted.

Surfactant usable in the present invention comprises at least one selection from the nonionic, cationic, anionic, and amphoteric surfactants. However, cationic surfactant/anionic surfactant combinations should be avoided due to the corresponding problems with treatment bath stability.

Nonionic surfactants usable in the method according to the present invention are exemplified by polyethylene glycol-type nonionic surfactants such as polyoxyethylene alkylphenyl ethers, polyoxyethylene alkyl ethers, polyoxyethylene fatty acid esters, polyoxyethylene sorbitan fatty acid esters, polyoxyethylene-polyoxypropylene block polymers, and so forth; polyvalent alcohol-type nonionic surfactants such as sorbitan fatty acid esters and so forth; and amide-type nonionic surfactants such as fatty acid alkylolamides and so forth.

Cationic surfactants usable in the method according to the present invention are exemplified by amine salt-type cationic surfactants such as the salts of higher alkylamines, polyoxyethylene higher alkylamine salts, and so forth and by quaternary ammonium salt-type cationic surfactants such as alkyltrimethylammonium salts and so forth.

Amphoteric surfactants usable in the method according to the present invention are exemplified by amino acid-type amphoteric surfactants such as methyl alkylaminopropionate and so forth and by betaine-type amphoteric surfactants such as alkyldimethylbetaines and so forth.

Anionic surfactants, however, generally have low solubilities in the acid region and for this reason their use in the present invention is frequently problematic. However, types in which ethylene oxide has been added, as in the higher alkyl ether sulfate ester salts, can be used since they retain good solubilities even in the acid region.

Concentrations of about 0.5 to 5 g/L are suitable for these surfactants in a zinc phosphate-based conversion treatment bath in the method according to the present invention. The type and concentration of the surfactant should be selected as appropriate as a function of the type and concentration (add-on) of the oil, grease, or other soil to be cleaned off.

The surface is cleaned at the same time as its conversion treatment when surfactant is present in the bath. When this method is run continuously, the cleaned off soil will usually therefore accumulate in the treatment bath. Since this accumulated soil is not inevitably benign or nondetrimental for the conversion treatment, its total accumulation is preferably limited to no more than 10 g/L. This restriction on the total accumulation will, however, vary as a function of the type of soil and the type and content of the surfactant.

After a conversion treatment with the surfactant-containing conversion bath, the resulting conversion film is rinsed with water and the residual water is eliminated from the surface of the conversion film. The water rinse may be implemented as a single-step or multistep process, but the final water rinse preferably uses deionized water.

The aforesaid water elimination process (drying process) is not an absolute requirement when the conversion film-carrying surface of the metal is to be coated with paint, for example, by electrodeposition. There are absolutely no restrictions on the drying temperature or time, e.g., drying can be carried out at room temperature or with heating.

This treatment of the metal surface with surfactant-containing conversion bath according to the present invention provides a thorough elimination of the oil, grease, dust, and/or metal particles and, at the same time as this cleaning, accelerates the conversion film-forming reactions through the presence of the conversion accelerator (organoperoxide).

Thus, the surface of the metal will be cleaned and, concurrently with this cleaning, a uniform, fine, and dense zinc phosphate-type conversion film having microfine film crystals will be formed on the cleaned metal surface.

The invention will be explained in greater detail below using working examples, which, however, are provided simply for purposes of explanation and should not be construed as limiting the scope of the invention.

EXAMPLES 1 TO 8 AND COMPARATIVE EXAMPLES 1 TO 4

The following metals were used in these working and comparative examples.

(1) Cold-rolled steel sheet (SPCC-SD, abbreviated below as SPC) with a sheet thickness of 0.8 mm.

(2) Galvanized steel sheet (abbreviated in the table as "plated") afforded by electrogalvanizing, to an add-on mass of 20 g/m$^2$, the type of cold-rolled steel sheet described in (1).

These metals were each cut into 70×150 mm coupons.

In these examples and comparative examples, conversion films were formed on the above-described metals using the following process sequence, unless otherwise stated. These films were intended for application as underpaint coatings (undercoats):

(1) Degreasing (FINECLEANER® L4460 alkaline degreaser, from Nihon Parkerizing Company, Limited, 20 g/L of agent A, 12 g/L of agent B) at 43° C. for 120 seconds by immersion;

(2) Water rinse with tap water at ambient temperature for 30 seconds, spray;

(3) Surface conditioning (colloidal titanium surface conditioner, trademark: PREPALENE® ZN from Nihon Parkerizing Company, Limited, 1 g/L aqueous solution), at ambient temperature for 30 seconds, spray;

(4) Zinc phosphate-based conversion treatment, with compositions described in the individual working and comparative examples, at 43° C. for 120 seconds immersion;

(5) water rinse, with tap water at ambient temperature for 30 seconds, spray;

(6) deionized water rinse (deionized water, conductivity=0.2 microSiemens/cm) at ambient temperature for 20 seconds, spray;

(7) drain and dry in a hot air current at 110° C. for 180 seconds.

However, in Examples 5 and 7 and Comparative Example 3, the surface-conditioning treatment in (3) was not run and the degreased and water rinsed metal surface was submitted to the zinc phosphate-based conversion treatment as in step (4) directly after degreasing (1) and the water rinse in step (2).

The free acidity in the zinc phosphate-based conversion baths in Examples 1 to 8 and Comparative Examples 1 to 4 was adjusted to the specified values, vide infra, using sodium hydroxide. The free acidity was measured by titrating 10 milliliters, hereinafter usually abbreviated as "mL", of the particular treatment bath to neutrality using 0.1 N aqueous sodium hydroxide and bromophenol blue as the indicator. The number of milliliters (mL) of the aqueous sodium hydroxide solution required for the color change from yellow to blue was determined and is reported as "points" of free acidity The fluoride ions concentration in the conversion baths was measured using a fluorine ion sensitive electrode.

The coating weight was measured as follows. The weight ("W1") in grams of the treated coupon after conversion treatment was first measured, and the treated coupon was then subjected to a film stripping treatment using the stripping solution and stripping conditions reported below. The weight of the stripped coupon was measured to give "W2" in grams, and the coating mass in g/m$^2$ was calculated from the formula (W1−W2)/(0.021).

Treatment for cold-rolled steel coupons stripping solution: 5% by weight of aqueous chromic acid solution stripping conditions: 75° C., 15 minutes, immersion.

Treatment for galvanized steel coupons stripping solution: 2% by weight of ammonium dichromate +49% by weight of 28% aqueous ammonia+49% by weight of pure water stripping conditions: ambient temperature, 15 minutes, immersion.

The appearance of the coatings was inspected visually, and the morphology and size of the grains in the conversion coating were evaluated by inspection with a scanning electron microscope ("SEM").

Conversion treatment bath (1) with the following composition was prepared in Example 1.

Composition of conversion treatment bath (1)

| | |
|---|---|
| phosphate ions | 15 g/L (from addition of 75% phosphoric acid) |
| zinc ions | 1.3 g/L (from addition of zinc oxide) |
| nickel ions | 1.0 g/L (from addition of nickel carbonate) |
| manganese ions | 0.5 g/L (from addition of manganese carbonate) |
| fluoride ions | 100 ppm (from addition of 55% hydrofluoric acid) |

450 ppm of tert-butyl hydroperoxide was added as the organoperoxide to the conversion bath with the above composition, and the free acidity of the conversion bath was then adjusted to 0.9 point. A cold-rolled steel test coupon was subjected first to the colloidal titanium surface-conditioning treatment (3) and then to conversion treatment at a temperature of 43° C. for 120 seconds, using the above-described conversion bath (1). The resulting conversion coating weight was 1.2 g/m$^2$. The coating crystals were plates with an average grain size of 6 micrometers. The conversion coating was grayish black and was uniform, fine, and dense. Other test results are reported in Table 1.

TABLE 1

| Identification | Substrate | Conc. in Treatment Comp. of: $PO_4^{-3}$, g/L | $Zn^{+2}$, g/L | N, ppm | Surface Conditioner? | Accelerator Used |
|---|---|---|---|---|---|---|
| Ex 1 | SPC | 15 | 1.3 | 0 | yes | a |
| Ex 2 | plated | 15 | 1.3 | 0 | yes | a |
| Ex 3 | SPC | 15 | 1.3 | 0 | yes | a |
| Ex 4 | SPC | 15 | 1.3 | 500 | yes | a |
| Ex 5 | SPC | 15 | 1.3 | 0 | no | b |
| Ex 6 | SPC | 15 | 1.3 | 0 | yes | c |
| Ex 7 | SPC | 15 | 1.3 | 0 | no | a |
| Ex 8 | SPC | 15 | 1.3 | 1400 | yes | a |
| CE 1 | SPC | 15 | 1.3 | 0 | yes | a |
| CE 2 | plated | 15 | 1.3 | 0 | yes | a |
| CE 3 | SPC | 15 | 1.3 | 1400 | no | d |
| CE 4 | SPC | 15 | 1.3 | 0 | yes | e |

| Identification | Conc. of Acc., ppm | Points of Free Acid | Coating Mass, $g/m^2$ | Coating Appearance | Coating Crystal Shape | Coating Grain Size, $\mu m$ |
|---|---|---|---|---|---|---|
| Ex 1 | 450 | 0.9 | 1.2 | Grayish black | plates | 6 |
| Ex 2 | 450 | 0.9 | 2.8 | grayish white | plates | 4 |
| Ex 3 | 80 | 0.6 | 0.9 | grayish black | plates | 8 |
| Ex 4 | 1200 | 0.9 | 1.1 | grayish black | plates | 7 |
| Ex 5 | 400 | 0.9 | 1.0 | grayish black | plates | 6 |
| Ex 6 | 100 | 0.6 | 1.3 | grayish black | plates | 10 |
| Ex 7 | 500 | 0.6 | 1.1 | grayish black | plates | 10 |
| Ex 8 | 450 | 0.9 | 1.1 | grayish black | plates | 5 |
| CE 1 | 5 | 0.9 | 0.5 | yellow rust appeared | columnar | 13 |
| CE 2 | 5 | 0.9 | 0.9 | sparse coating | columnar | 15 |
| CE 3 | 150 | 0.9 | 0.1 | yellow rust appeared | granular | 80 |
| CE 4 | 1500 | 0.9 | 0.9 | sparse coating | columnar | 15 |

Abbreviations in, and Other Notes for, Table 1
"Ex" means "Example"; "CE" means "Comparative Example"; "Conc." means "Concentration"; "Comp." means "Composition"; "Acc." means "Accelerator"; "$\mu$m" means "micrometers".
In the column headed "Accelerator Used":
"a" means tert-butyl hydroperoxide;
"b" means tert-hexyl hydroperoxide;
"c" means peracetic acid;
"d" means nitrite ions;
"e" means chlorate ions.

In Example 2, a galvanized steel test coupon was subjected first to the same degreasing (1), water rinse (2), and surface-conditioning treatment (3) as in Example I and then to conversion treatment as in Example 1 using conversion treatment bath (1). The resulting conversion coating weight was 2.8 $g/m^2$. The crystals were plates with an average grain size of 4 micrometers. The conversion coating was grayish white and was uniform, fine, and dense.

In Example 3, a cold-rolled steel test coupon was subjected first to the same surface-conditioning treatment as in Example 1 and then to conversion treatment using the same conversion treatment bath as in Example 1, except that the organoperoxide consisted of 80 ppm tert-butyl hydroperoxide and the free acidity was adjusted to 0.6 point. The resulting conversion coating weight was 0.9 $g/m^2$. The crystals were plates with an average grain size of 8 micrometers. The conversion coating was grayish black and was uniform, fine, and dense.

In Example 4, a cold-rolled steel test coupon was subjected first to the same surface-conditioning treatment as in Example 1 and then to conversion treatment using the same conversion treatment bath as in Example 1, except that 1200 ppm of tertbutyl hydroperoxide was the organoperoxide and sufficient 65.5% nitric acid was added to give a nitrogen component content of 500 ppm. The free acidity of the conversion bath was adjusted to 0.9 point. The resulting conversion coating weight was 1.1 $g/m^2$. The coating crystals were plates with an average grain size of 7 micrometers. The conversion coating was grayish black and was uniform, fine, and dense.

In Example 5, a cold-rolled steel test coupon, without any surface-conditioning treatment, was subjected to conversion treatment as in Example 1, except that 400 ppm of tert-hexyl hydroperoxide was the organoperoxide. The free acidity was adjusted to 0.9 point. The resulting conversion coating weight was 1.0 $g/m^2$. The coating crystals were plates with an average grain size of 6 micrometers. The conversion coating was grayish black and was uniform, fine, and dense.

In Example 6, a cold-rolled steel test coupon was subjected first to the same surface-conditioning treatment as in Example 1 and then to conversion treatment using the same conversion treatment bath as in Example 1, except that 100 ppm of peracetic acid was the organoperoxide, and the free acidity was adjusted to 0.6 point. The resulting conversion coating weight was 1.3 $g/m^2$. The coating crystals were plates with an average grain size of 10 micrometers. The conversion coating was grayish black and was uniform, fine, and dense.

In Example 7, a cold-rolled steel test coupon, without any surface conditioning treatment, was subjected to conversion treatment using the same conversion bath as in Example 1, except that 500 ppm of tert-butyl hydroperoxide was added as the organoperoxide, and the free acidity was adjusted to 0.6 point. The resulting conversion coating weight was 1.1 g/m$^2$. The coating crystals were plates with an average grain size of 10 micrometers. The conversion coating was grayish black and was uniform, fine, and dense.

Conversion treatment bath (2) with the following composition was prepared for Example 8.

Composition of conversion treatment bath (2)

| | |
|---|---|
| phosphate ions | 15 g/L (from addition of 75% phosphoric acid) |
| zinc ions | 1.3 g/L (from addition of zinc oxide) |
| nickel ions | 1.0 g/L (from addition of nickel carbonate) |
| manganese ions | 0.5 g/L (from addition of manganese carbonate) |
| fluoride ions | 100 ppm (from addition of 55% hydrofluoric acid) |
| nitrate ions | 7.2 g/L (from addition of sodium nitrate and nickel nitrate) (nitrogen concentration = 1.4 g/L) |

450 ppm of tert-butyl hydroperoxide was added as the organoperoxide to the conversion bath with the above composition, and the free acidity of the conversion bath was then adjusted to 0.9 point. A cold-rolled steel test coupon was subjected first to the colloidal titanium surface-conditioning treatment and then to conversion treatment (conversion temperature=43° C., treatment time=120 seconds) using the above-described conversion bath. The resulting conversion coating weight was 1.1 g/m$^2$. The coating crystals were plates with an average grain size of 5 micrometers. The conversion coating was grayish black and was uniform, fine, and dense.

In Comparative Example 1, a cold-rolled steel test coupon was subjected to the same surface-conditioning treatment as in Example I and was then submitted to the same conversion treatment as in Example 1, except that the organoperoxide consisted of 5 ppm of tert-butyl hydroperoxide. The conversion coating weight was 0.5 g/m$^2$, and the development of yellow rust was observed.

In Comparative Example 2, a galvanized steel test coupon was subjected to conversion treatment as in Example 1, except that the organoperoxide consisted of 5 ppm of tert-hydroperoxide. The conversion coating weight was 0.9 g/m$^2$, the average grain size was 15 micrometers, and the coating was sparse.

In Comparative Example 3, a cold-rolled steel test coupon, without any surface-conditioning treatment, was subjected to conversion treatment as in Example 8, except that 150 ppm of nitrite ions were added to the conversion bath in place of the organoperoxide. The conversion coating weight was 0.1 g/m$^2$, which indicated that almost no conversion coating deposition had occurred. Yellow rust had developed over the entire surface.

In Comparative Example 4, a cold-rolled steel test coupon was subjected to conversion treatment as in Example 1. In this case, however, sodium chlorate was added to the conversion bath in place of the organoperoxide to give a chlorate ions concentration of 1.5 g/L. The conversion coating weight was 0.9 g/m$^2$. The coating crystals were columnar and the average grain size was 15 micrometers. The conversion coating was sparsely deposited, and yellow rust was observed.

The test results are reported in Table 1. The organoperoxide concentrations used in Examples 1 to 8 were within the range from 50 to 1,500 ppm. It was thereby confirmed that this concentration range produced a good-quality conversion coating on cold-rolled steel sheet as well as galvanized steel sheet. A uniform, dense, and fine coating was obtained even when the surface-conditioning treatment was not used.

In contrast, Comparative Examples 1 and 2 used organoperoxide concentrations below 50 ppm, and it was confirmed that in these cases the oxidation activity by the conversion accelerator was inadequate, resulting in the deposition of only scattered coating crystals. The uniformity of the coating on the substrate metal was therefore diminished.

Comparative Examples 3 and 4 used non-organoperoxide conversion accelerators. In Comparative Example 3, nitrite ions were used as the conversion accelerator and no surface-conditioning treatment was carried out. It was confirmed that in this case conversion coating deposition was entirely absent. Chlorate ions were used by themselves as the conversion accelerator in Comparative Example 4. It was confirmed that in this case the conversion reaction rate was substantially slowed.

EXAMPLES 9 TO 15

The following metals were used in these examples:

(1) Cold-rolled steel sheet (SPCC-SD, sheet thickness: 0.8 mm, abbreviated below as "SPC")

(2) Zinc-electroplated steel sheet (sheet thickness: 0.8 mm, plating weight: both surfaces 30 g/m$^2$, abbreviated below as "EG")

(3) Galvannealed hot-dip zinc-plated steel sheet (sheet thickness: 0.8 mm, plating weight: both surfaces 45 g/m$^2$, abbreviated below as "GA")

(4) Aluminum-magnesium alloy sheet (Japanese Industrial Standard-A5052, sheet thickness: 1.0 mm, abbreviated below as "AL").

In each case the metals were cut to 70×150 mm to prepare the specimens that were then subjected to the treatments in the working and comparative examples. Each test material was coated with 2 g/m$^2$ of a commercial cleaning/rust-preventing oil.

The same treatments as in Example 1 were executed on the metal specimens in each of Examples 9 to 15 with the following modifications: the surface-conditioning treatment was omitted and conversion baths (3), (4), and (5) with the compositions given below were used in place of conversion bath (1).

Composition of Conversion Treatment Bath (3)

| | |
|---|---|
| phosphate ions | 15 g/L (from addition of 75% phosphoric acid) |
| zinc ions | 1.3 g/L (from addition of zinc oxide) |
| nickel ions | 0.5 g/L (from addition of nickel carbonate) |
| fluorine component | 1.0 g/L (from addition of sodium fluosilicate) |
| 2-butanol | 30 g/L |
| conversion accelerator | see below |
| free acidity | 0.6 point |

Composition of Conversion Treatment Bath (4)

| | |
|---|---|
| phosphate ions | 13 g/L (from addition of 75% phosphoric acid) |
| zinc ions | 1.1 g/L (from addition of zinc oxide) |
| cobalt ions | 0.4 g/L (from addition of basic cobalt carbonate) |
| fluorine component | 0.4 g/L (from addition of sodium fluoride) |
| conversion accelerator | see below |
| free acidity | 0.4 point |

Composition of Conversion Treatment Bath (5)

| | |
|---|---|
| phosphate ions | 17 g/L (from addition of 75% phosphoric acid) |
| zinc ions | 1.5 g/L (from addition of zinc oxide) |
| conversion accelerator | see below |
| free acidity | 0.7 point |

Each of the conversion baths (3) to (5) was adjusted to the specified free acidity using sodium hydroxide. Otherwise, the free acidity (points), conversion coating weight, and status and size of the coating crystals were measured as described above.

Standards for Reporting the Evaluation of the Grain Size of the Coating Crystals (1) for cold-rolled steel sheet:

+ less than 35 micrometers x greater than or equal to 35 micrometers (2) for zinc-electroplated steel sheet + less than 25 micrometers x greater than or equal to 25 micrometers (3) for galvannealed hot-dip zinc-plated steel sheet:

+ less than 30 micrometers x greater than or equal to 30 micrometers (4) for aluminum-magnesium alloy sheet:

+ less than 30 micrometers x greater than or equal to 30 micrometers

Standard for Reporting Evaluation of Substrate Metal Coverage

Considered over the entire material:

+ absolutely no exposure of substrate metal x exposure of substrate metal was observed Conversion-treated test panels were electrodeposition painted using a cationic electrodeposition paint (Elecron™ 2000 from Kansai Paint Kabushiki Kaisha) to give a paint film with a film thickness of 20 micrometers. These painted specimens were then subjected to the following painting performance tests in order to evaluate the painting performance:

(1) Test of the Post-painting Corrosion Resistance

A cut was introduced into the paint film on the painted sample. The painted sample was thereafter immersed for 240 hours in 5% aqueous sodium chloride solution heated to 50° C. and then removed, rinsed with water, and dried. The neighborhood of the cut was peeled using cellophane tape, and the maximum width of paint film peeling on one side was measured after the tape peel and reported on the following scale:

| | |
|---|---|
| + | maximum one-side width of peel is less than 7 mm |
| # | maximum one-side width of peel is at least 7 mm but less than 10 mm |
| × | maximum one-side width of peel is at least 10 mm |

(2) Test of the Water-resistant Secondary Adherence

The painted sample was immersed for 240 hours in pure water heated to 40° C. and then removed and dried. A cross was thereafter scribed in the paint film; the center of the cut was extruded 3 mm using an Erichsen tester; and, after a cellophane tape peel, the paint film peel ratio (peeled area/extruded area) was measured. The following scale was used for reporting:

| | |
|---|---|
| + | paint film peel ratio is less than 10% |
| # | paint film peel ratio is at least 10% but less than 20% |
| × | paint film peel ratio is at least 20% |

In Example 9, 200 ppm of tertbutyl hydroperoxide was added as conversion accelerator to conversion treatment bath (3), which was then used to conversion treat the cold-milled steel sheet by immersion at a treatment temperature of 45° C. The treatment conditions and test results are reported in Tables 2 and 3, respectively.

In Example 10, 80 ppm of di-tert-butyl peroxide was added as conversion accelerator to conversion treatment bath (3), which was then used to conversion treat the zinc-electroplated steel sheet by immersion at a treatment temperature of 45° C. The treatment conditions and test results are reported in Tables 2 and 3, respectively.

TABLE 2

| Ex # | Sub. | $PO_4^{-3}$, g/L | $Zn^{+2}$, g/L | Other Metal Ion, g/L | Peroxide, g/L | F, g/L | Free Acid Points | Treatment Temp., ° C. | Contact Method |
|---|---|---|---|---|---|---|---|---|---|
| 9 | SPC | 15 | 1.3 | Ni:0.5 | a:200 | 1.0 | 0.6 | 45 | imm. |
| 10 | EG | 15 | 1.3 | Ni:0.5 | f:80 | 1.0 | 0.6 | 45 | imm. |
| 11 | SPC | 13 | 1.1 | Co:0.4 | a:500 | 0.4 | 0.4 | 40 | spray |
| 12 | EG | 13 | 1.1 | Co:0.4 | g:1100 | 0.4 | 0.4 | 40 | imm. |
| 13 | SPC | 15 | 1.3 | Ni:0.5 | f:500 | 1.0 | 0.6 | 43 | imm. |
| 14 | GA | 17 | 1.5 | — | a:500 | — | 0.7 | 33 | spray |
| 15 | AL | 15 | 1.3 | Ni:0.5 | f:150 | 1.0 | 0.6 | 43 | spray |

Additional Abbreviations in and Other Notes for Table 2

"#" means "Number"; "Temp." means "Temperature"; "imm." means "immersion.

In the column headed "Peroxide, g/L":

"a" means "tert-butyl hydroperoxide";

"f" means "di-tert-butyl peroxide";

"g" means "acetylacetone peroxide".

TABLE 3

| Example Number | Coating Mass, g/m$^2$ | Coating Grain Size Rating | Coverage Rating | Post-Painting Corrosion Rating | Water-Resistant Secondary Adherence Rating |
|---|---|---|---|---|---|
| 9 | 0.9 | + | + | + | + |
| 10 | 3.5 | + | + | + | + |
| 11 | 1.2 | + | + | + | + |
| 12 | 3.2 | + | + | + | + |
| 13 | 1.3 | + | + | + | + |
| 14 | 4.3 | + | + | # | + |
| 15 | 2.5 | + | + | + | + |

In Example 11, 500 ppm of tert-butyl hydroperoxide was added as conversion accelerator to conversion treatment bath (4), which was then used to conversion treat the cold-rolled steel sheet by spraying at a treatment temperature of 40° C. The treatment conditions and test results are reported in Tables 2 and 3, respectively.

In Example 12, 1100 ppm of acetylacetone peroxide was added as cone version accelerator to conversion treatment bath (4), which was then used to conversion treat the zinc-electroplated steel sheet by immersion at a treatment temperature of 40° C. The treatment conditions and test results are reported in Tables 2 and 3, respectively.

In Example 13, 500 ppm of di-tert-butyl peroxide was added as conversion accelerator to conversion treatment bath (3), which was then used to conversion treat the cold-rolled steel sheet by immersion at a treatment temperature of 43° C. The treatment conditions and test results are reported in Tables 2 and 3, respectively.

In Example 14, 500 ppm of tertbutyl hydroperoxide was added as conversion accelerator to conversion treatment bath (5), which was then used to conversion treat the galvannealed hot-dip zinc-plated steel sheet by spraying at a treatment temperature of 33° C. The treatment conditions and test results are reported in Tables 2 and 3, respectively.

In Example 15, 150 ppm of di-tert-butyl peroxide was added as conversion accelerator to conversion treatment bath (3), which was then used to conversion treat the aluminum-magnesium alloy sheet by spraying at a treatment temperature of 43° C. The treatment conditions and test results are reported in Tables 2 and 3, respectively.

COMPARATIVE EXAMPLES 5 TO 9

In each of Comparative Examples 5 to 9, the same treatments and tests were run as in Example 9, with the exception of the modifications given below.

In Comparative Example 5, 200 ppm nitrite ions was added as conversion accelerator to conversion treatment bath (3), which was then used to conversion treat the cold-rolled steel sheet by immersion in the treatment bath at a treatment temperature of 43° C. The treatment conditions and test results are reported in Tables 4 and 5, respectively.

TABLE 4

| CE # | Sub. | $PO_4^{-3}$, g/L | $Zn^{+2}$, g/L | Other Metal Ions, g/L | Accel-erator, g/L | F, g/L | Free Acid Points | Treat-ment Temp., ° C. | Con-tact Method |
|---|---|---|---|---|---|---|---|---|---|
| 5 | SPC | 15 | 1.3 | Ni:0.5 | d:200 | 1.0 | 0.6 | 43 | imm. |
| 6 | SPC | 15 | 1.3 | Ni:0.5 | — | 1.0 | 0.6 | 43 | imm. |
| 7 | EG | 13 | 1.1 | Co:0.4 | e:2000 | 0.4 | 0.4 | 40 | imm. |
| 8 | GA | 17 | 1.5 | — | — | — | 0.7 | 33 | spray |
| 9 | AL | 15 | 1.3 | Ni:0.5 | — | 1.0 | 0.6 | 43 | spray |

Additional Notes for Table 4
In the column headed "Accelerator, g/L":
d: nitrite ions
e: chlorate ions

TABLE 5

| Comparative Example Number | Coating Mass, g/m$^2$ | Coating Grain Size Rating | Coverage Rating | Post-Painting Corrosion Rating | Water-Resistant Secondary Adherence Rating |
|---|---|---|---|---|---|
| 5 | 4.0 | x | x | # | x |
| 6 | 0.5 | x | x | x | # |
| 7 | 5.2 | x | + | # | x |
| 8 | 7.3 | x | + | x | x |
| 9 | 1.3 | x | x | x | # |

In Comparative Example 6, conversion treatment bath (3)—without the addition of conversion accelerator—was heated to 43° C., and the cold-rolled steel sheet was conversion treated by immersion in this treatment bath. The treatment conditions and test results are reported in Tables 4 and 5, respectively.

In Comparative Example 7, 2000 ppm of chlorate ions was added as conversion accelerator to conversion treatment bath (4), which was then used to conversion treat the zinc-electroplated steel sheet by immersion at a treatment temperature of 40° C. The treatment conditions and test results are reported in Tables 4 and 5, respectively.

In Comparative Example 8, conversion treatment bath (5)—without the addition of conversion accelerator—was heated to 33° C., and the galvannealed hot-dip zinc-plated steel sheet was conversion treated by spraying with this bath. The treatment conditions and test results are reported in Tables 4 and 5, respectively.

In Comparative Example 9, conversion treatment bath (3)—without the addition of conversion accelerator—was heated to 43° C., and the aluminum-magnesium alloy sheet was conversion treated by spraying with this bath. The treatment conditions and test results are reported in Tables 4 and 5, respectively.

Examples 9 to 15, which employed a surface treatment method according to the present invention, consisted of treatment using a conversion treatment bath that contained organoperoxide as the conversion accelerator. As Tables 2 to 5 clearly show, in each case this resulted in the deposition of a thin, uniform, fine, and dense zinc phosphate-type conversion coating on the surface of the metal work and in an excellent painting performance (post-painting corrosion resistance and water-resistant secondary adherence). In Comparative Examples 6, 8, and 9, treatment was carried out using a conversion treatment bath that was entirely free of conversion accelerator. In contrast to the examples, the oxidizing activity in these comparative examples was inadequate, and only sparse coating crystals were deposited and the substrate metal was not uniformly covered. Comparative Examples 5 and 7 employed, respectively, nitrite ions, which are the conversion accelerator most typically used in the prior art, and chlorate ions. Fine, dense films were not deposited in these comparative examples and a satisfactory painting performance was therefore not obtained.

EXAMPLES 16 TO 22 AND COMPARATIVE EXAMPLES 10 TO 14

Examples 16 to 22 and Comparative Examples 10 to 14 employed the same cold-rolled steel sheet (SPC sheet) as in Example 9, the same zinc-electroplated steel sheet and galvannealed hot-dip zinc-plated steel sheet (sheet thickness: 2.8 mm, plating weight: both surfaces 45 g/m$^2$) as in Example 10, and the same aluminum-magnesium alloy sheet as in Example 15. The metal sheets were coated with 2 g/m$^2$ of a commercial cleaning/rust-preventing oil (NOX-RUST™ 550 from Parker Kosan Kabushiki Kaisha).

The treatment processes common to Examples 16 to 22 and Comparative Examples 10 to 14 are given below.

(1) cleaning/conversion treatment

The specific conditions are given below in the respective working and comparative examples.

(2) tap-water rinse ambient temperature, 30 seconds, spray (3) deionized water rinse deionized water with a conductivity of 0.2 microSiemens/cm ambient temperature, 20 seconds, spray (4) drain/dry hot air current at 110° C. for 180 seconds Each of the cleaning/conversion treatment baths used in the working and comparative examples was adjusted to the specified free acidity, vide infra, using sodium hydroxide unless specified otherwise. The free acidity (in points) of the treatment baths was measured as in Example 1.

The conversion coating weight was measured as in Example 1. The coating was stripped in these measurements using the following procedures.

Stripping Conditions (1) For the cold-rolled steel sheet stripping solution: 5% aqueous chromic acid stripping conditions: 75° C., 15 minutes, immersion stripping (2) For the zinc-plated sheet stripping solution: 2% by weight ammonium dichromate+49% by weight of 28% aqueous ammonia+49% by weight pure water stripping conditions: room temperature, 15 minutes, immersion stripping (3) For the aluminum-magnesium alloy sheet stripping solution: 5% aqueous chromic acid stripping conditions: room temperature, 5 minutes, immersion stripping The deposited coating crystals were inspected with a scanning electron microscope ("SEM") at 1,000×. This magnified image was used to evaluate substrate metal coverage (presence or absence of exposed substrate) and to measure the particle size of the conversion coating crystals for evaluation of finely sized crystal formation.

The following standards were used for reporting the substrate metal coverage and for evaluation of coating grain size.

(1) In Standard for evaluation of coating grain size

++ less than 30 micrometers (good)

+ at least 30 micrometers but less than 50 micrometers (moderately poor)

x at least 50 micrometers (poor)

(2) Standard for evaluation of substrate metal coverage

++ absolutely no exposure of substrate metal (good)

+ moderate exposure of substrate metal (moderately poor)

x substrate metal completely exposed (poor)

In Example 16, the cleaning/conversion treatment bath (6) specified be low was heated to 45° C. and used to conversion treat the cold-rolled steel sheet by immersion for 180 seconds. The resulting coating weight was 1.2 g/m$^2$, and the coating grain size and substrate metal coverage were both evaluated as good.

Composition of Conversion Treatment Bath (6)

| | | |
|---|---|---|
| phosphate ions | 15 | g/L (from addition of 75% phosphoric acid) |
| zinc ions | 1.3 | g/L (from addition of zinc oxide) |
| nickel ions | 0.5 | g/L (from addition of nickel carbonate) |
| fluorine component | 1.0 | g/L (from addition of sodium fluosilicate) |
| organoperoxide | 500 | ppm (of tert-butyl hydroperoxide) |
| tert-butanol | 4.0 | g/L |
| surfactant | 1.0 | g/L (addition of polyoxyethylene-polyoxypropylene block polymer with an average molecular weight of 10,000 and an ethylene oxide addition proportion of 80%) |
| oil component | 2.0 | g/L (addition of NOX-RUST ™ 550) |
| free acidity | 0.6 | point |

The test results are reported in Table 6.

TABLE 6

| Identification | Substrate | Accelerator(s) | Surfactant(s) | Coating Grain Size Rating | Coverage Rating |
|---|---|---|---|---|---|
| Ex 16 | SPC | a: 500 | A: 1.0 | ++ | ++ |
| Ex 17 | EG | a: 500 | A: 1.0 | ++ | ++ |
| Ex 18 | SPC | f: 1000 | B: 1.0 + C: 0.5 | ++ | ++ |
| Ex 19 | EG | f: 1000 | B: 1.0 + C: 0.5 | ++ | ++ |
| Ex 20 | SPC | g: 100 | D: 1.5 + E: 0.5 | ++ | ++ |
| Ex 21 | EG | g: 100 | D: 1.5 + E: 0.5 | ++ | ++ |
| Ex 22 | AL | g: 100 | D: 1.5 + E: 0.5 | ++ | ++ |
| CE 10 | SPC | d: 100 + h: 7000 | None | None | x |
| CE 11 | EG | d: 100 + h: 7000 | A: 1.0 | x | ++ |
| CE 12 | SPC | None | B: 1.0 + C: 0.5 | x | x |
| CE 13 | EG | e: 1500 | B: 1.0 + C: 0.5 | x | + |
| CE 14 | AL | e: 1500 | B: 1.0 + C: 0.5 | None | x |

Additional Abbreviation in. and Notes for, Table 6
"a" means tert-butyl hydroperoxide (an organoperoxide);
"f" means di-tert-butyl peroxide (an organoperoxide);
"g" means acetylacetone peroxide (an organoperoxide);
"h" means nitrate ions;
"d" means nitrite ions;
"e" means sodium chlorate.
"A" means polyoxyethylene-polyoxypropylene block polymer;
"B" means polyoxyethylene sorbitan monolaurate;
"C" means lauryl ether sulfate ester salt;
"D" means polyoxyethylene oleyl ether;
"E" means lauryldimethylbetaine.
In the column headed "Coating Grain Size Rating", the entry "None" means that no coating formed.

In Example 17, the cleaning/conversion treatment bath (6) described in Example 16 was used to conversion treat the zinc-plated sheet by immersion for 180 seconds. The resulting coating weight was 3.5 g/m$^2$, and the coating grain size and substrate metal coverage were both evaluated as good. The test results are reported in Table 6.

In Example 18, the cleaning/conversion treatment bath (7) specified below was heated to 40° C. and used to conversion treat the cold-rolled steel sheet by spraying for 120 seconds. The resulting coating weight was 1.2 g/m$^2$, and the coating grain size and substrate metal coverage were both evaluated as good.

Composition of Conversion Treatment Bath (7)

| | | |
|---|---|---|
| phosphate ions | 14 | g/L (from addition of 75% phosphoric acid) |
| zinc ions | 1.3 | g/L (from addition of zinc oxide) |
| cobalt ions | 0.5 | g/L (from addition of basic cobalt carbonate) |
| organoperoxide | 1000 | ppm (from addition of di-tert-butyl peroxide) |
| tert-butanol | 2.0 | g/L |
| surfactant | 1.0 | g/L (from addition of polyoxyethylene sorbitan monolaurate with moles of EO addition = 20) |
| | 0.5 | g/L (from addition of lauryl ether sulfate ester salt with moles of EO additon = 3) |
| oil component | 3.0 | g/L (from addition of NOX-RUST ™ 550) |
| free acidity | 0.5 | point |

The test results are reported in Table 6.

In Example 19, the cleaning/conversion treatment bath (7) described in Example 18 was used to conversion treat the zinc-plated sheet by spraying for 120 seconds. The resulting coating weight was 3.3 g/m$^2$, and the coating grain size and substrate metal coverage were both evaluated as good. The test red suits are reported in Table 6.

In Example 20, the cleaning/conversion treatment bath (8) specified below was heated to 43° C. and used to conversion treat the cold-rolled steel sheet by spraying for 30 seconds and then immersion for 90 seconds. The resulting coating weight was 1.3 g/m$^2$, and the coating grain size and substrate metal coverage were both evaluated as good.

Composition of Conversion Treatment Bath (8)

| | | |
|---|---|---|
| phosphate ions | 17 | g/L (from addition of 75% phosphoric acid) |
| zinc ions | 1.5 | g/L (from addition of zinc oxide) |
| fluorine component | 0.4 | g/L (from addition of sodium fluoride) |
| organoperoxide | 100 | ppm (from addition of aceylacetone peroxide) |
| oil component | 2.0 | g/L (from addition of NOX-RUST ™ 550) |
| surfactant | 1.5 | g/L (from addition of polyoxyethylene oleyl ether with moles of EO addition = 7) |
| | 0.5 | g/L (from addition of lauryldimethylbetaine) |
| free acidity | 0.7 | point |

The test results are reported in Table 6.

In Example 21, the conversion treatment bath (8) described for Example 20 was used to conversion treat the zinc-plated sheet by spraying for 30 seconds and then immersion for 90 seconds. The resulting coating weight was 3.6 g/m$^2$, and the coating grain size and substrate metal coverage were both evaluated as good.

The test results are reported in Table 6.

In Example 22, the conversion treatment bath (8) described for Example 20 was used to conversion treat the aluminum alloy sheet by spraying for 30 seconds and then immersion for 90 seconds. The resulting coating weight was 2.5 g/m$^2$, and the coating grain size and substrate metal coverage were both evaluated as good.

The test results are reported in Table 6.

In Comparative Example 10, the conversion treatment bath (9) specified below was heated to 45° C. and used to conversion treat the cold-rolled steel sheet by immersion for 180 seconds. Because neither organoperoxide nor surfactant was added to this treatment bath, the oil component was not removed even upon completion of the treatment and coating deposition was completely absent.

Composition of Conversion Treatment Bath (9)

| | | |
|---|---|---|
| phosphate ions | 15 | g/L (from addition of 75% phosphoric acid) |
| zinc ions | 1.3 | g/L (from dissolution of zinc oxide) |
| nickel ions | 0.5 | g/L (from addition of nickel nitrate) |
| fluorine component | 1.0 | g/L (from addition of sodium fluosilicate) |
| nitrate ions | 7.0 | g/L (from addition of nickel and sodium nitrates) |
| nitrite ions | 100 | ppm (from addition of sodium nitrite) |
| oil component | 2.0 | g/L (addition of NOX-RUST ™ 550) |
| free acidity | 0.6 | point |

The test results are reported in Table 6.

In Comparative Example 11, the conversion treatment bath (10) specified below was heated to 45° C. and used to conversion treat the zinc-plated sheet by immersion for 180 seconds. The resulting coating weight was 5.3 g/m$^2$, and the substrate metal coverage was evaluated as good. However, because no organoperoxide was present, the crystal particles were coarse and coating grain size was evaluated as poor.

Composition of Conversion Treatment Bath (10)

| | | |
|---|---|---|
| phosphate ions | 15 | g/L (from addition of 75% phosphoric acid) |
| zinc ions | 1.3 | g/L (from addition of zinc oxide) |
| nickel ions | 0.5 | g/L (from addition of nickel nitrate) |
| fluorine component | 1.0 | g/L (from addition of sodium fluosilicate) |
| nitrate ions | 7.0 | g/L (from addition of nickel and sodium nitrates) |

-continued

| | |
|---|---|
| nitrite ions | 100 ppm (from addition of sodium nitrite) |
| surfactant | 1.0 g/L (from addition of polyoxyethylene-polyoxypropylene block polymer with an average molecular weight of 10,000 and an ethylene oxide addition proportion of 80%) |
| oil component | 2.0 g/L (from addition of NOX-RUST ™ 550) |
| free acidity | 0.6 point |

The test results are reported in Table 6.

In Comparative Example 12, the conversion treatment bath (11) specified below was heated to 40° C. and used to conversion treat the cold-rolled steel sheet by spraying for 120 seconds. The resulting coating weight was 0.3 g/m$^2$. However, there was an absence of organoperoxide, and the coating grain size and substrate metal coverage were both evaluated as poor.

Composition of Conversion Treatment Bath (11)

| | |
|---|---|
| phosphate ions | 14 g/L (from addition of 75% phosphoric acid) |
| zinc ions | 1.3 g/L (from addition of zinc oxide) |
| cobalt ions | 0.5 g/L (from addition of basic cobalt carbonate) |
| surfactant | 1.0 g/L (from addition of polyoxyethylene sorbitan monolaurate with moles of EO addition = 20) |
| | 0.5 g/L (from addition of lauryl ether sulfate ester salt with moles of EO additon = 3) |
| oil component | 3.0 g/L (from addition of NOX-RUST ™ 550) |
| free acidity | 0.5 point |

The test results are reported in Table 6.

In Comparative Example 13, the conversion treatment bath (12) specified below was heated to 40° C. and used to conversion treat the zinc-plated steel sheet by spraying for 120 seconds. The resulting coating weight was 2.1 g/m$^2$. However, there was an absence of organoperoxide, and the coating grain size was evaluated as poor and the substrate metal coverage was evaluated as moderately poor.

Composition of Conversion Treatment Bath (12)

| | |
|---|---|
| phosphate ions | 14 g/L (from addition of 75% phosphoric acid) |
| zinc ions | 1.3 g/L (from addition of zinc oxide) |
| cobalt ions | 0.5 g/L (from addition of basic cobalt carbonate) |
| chlorate ions | 1.5 g/L (from addition of sodium chlorate) |
| surfactant | 1.0 g/L (from addition of polyoxyethylene sorbitan monolaurate with moles of EO addition = 20) |
| | 0.5 g/L (from addition of lauryl ether sulfate ester salt with moles of EO additon = 3) |
| oil component | 3.0 g/L (addition of NOX-RUST ™ 550) |
| free acidity | 0.5 point |

The test results are reported in Table 6.

In Comparative Example 14, the conversion treatment bath described for Comparative Example 13 was used to conversion treat the aluminum sheet by spraying for 120 seconds. However, film deposition was entirely absent due to the absence of the organoperoxide.

Table 6 reports the substrates, the conversion accelerators and surfactants in the conversion treatment baths, and the results of the post-treatment evaluation of the coating crystals for Examples 16 to 22 and Comparative Examples 10 to 14. These results confirm that Examples 16 to 22, which employed a surface treatment method according to the present invention, were able to clean even the surface of oil-coated metal while simultaneously depositing thereon a uniform, fine, and dense zinc phosphate-type conversion coating.

Comparative Example 10 involved treatment with a surfactant-free conversion treatment bath, and in contrast to the above results was unable to deposit a conversion film due to an inadequate removal of the oil/grease component Comparative Example 12 involved treatment with a conversion accelerator-free treatment bath, and in this case the microfine-sizing of the crystals in the coating and coating coverage were inadequate. Comparative Examples 11 and 13 concerned treatment with organoperoxide-tree baths that contained inorganic conversion accelerators. In these cases, the film crystals were coarse, so that a uniform, fine, and dense conversion film was not obtained. Comparative Example 14 used an inorganic conversion accelerator, but a conversion film was not formed.

Benefits of the Invention

Because a zinc phosphate-based conversion treatment bath according to the present invention—and hence a bath used in a treatment method according to the present invention—is substantially free of nitrogenous compounds, effluent from the method according to the present invention is also environmentally nonpolluting as a practical matter, and the bath and method according to the present invention are therefore able to meet environmental regulations and restrictions. The general limitation of the total nitrogenous compound content in the bath to 0 to 200 ppm as nitrogen poses very little risk of environmental pollution.

A conversion treatment bath and surface treatment method according to the present invention cause the deposition of uniform, fine, and dense zinc phosphate-type conversion films on metals. These films also support an excellent painting performance, for example, in terms of post-painting corrosion resistance and water-resistant secondary adherence. Moreover, the invention uses a very simple process sequence, i.e., cleaning (degreasing)—conversion treatment—water rinse. As a result, the surface treatment method using a conversion bath according to the present invention does not require the surface-conditioning treatment required in the prior art for the deposition of uniform, fine, and dense conversion films. As this provides a number of advantages, such as a simplification of the treatment facilities, release from complicated bath management, and savings because surface conditioner is no longer required, the bath and method according to the present invention clearly represent a major technological advance.

Moreover, through the introduction of a surfactant for surface cleaning into the conversion bath according to the present invention, degreasing and zinc phosphate-based conversion treatment can be simultaneously effected in a single step on the surfaces of metals that bear, for example, oil and/or grease. This also yields a uniform, fine, and dense conversion coating. The merits accruing to the use of the cleaning/conversion treatment method according to the present invention extend over a broad range, including, for example, a substantial shortening of the treatment sequence, simplification of the treatment facilities, space savings, increased productivity, a reduction in reagent costs, simplification of reagent management, and so forth.

The invention claimed is:

1. A liquid zinc phosphate conversion coating bath composition comprising water, zinc ions, phosphate ions, and from 50 to 1500 ppm of an organoperoxide conversion accelerator selected from the group consisting of ethyl hydroperoxide, isopropyl hydroperoxide, tert-butyl hydroperoxide, tert-hexyl hydroperoxide, diethyl peroxide, di-tert-butyl peroxide, acetylacetone peroxide, cumene hydroperoxide, tert-butylperoxymaleic acid, monoperphthalic acid, and persuccinic acid.

2. A bath composition according to claim, wherein nitrogenous compounds are present, if at all, only in an amount having a stoichiometric equivalent as nitrogen of not more than 200 ppm.

3. A bath composition according to claim 2, comprising from 50 to 1500 ppm of organoperoxides that are water-soluble and have a peroxy structure or a percarboxyl structure.

4. A bath composition according to claim 3, wherein said organoperoxides are selected from ethyl hydroperoxide, isopropyl hydroperoxide, tert-butyl hydroperoxide, tert-hexyl hydroperoxide, diethyl peroxide, di-tert-butyl peroxide, acetylacetone peroxide, cumene hydroperoxide, tert-butylperoxymaleic acid, peracetic acid, monoperphthalic acid, and persuccinic acid.

5. A bath composition according to claim 4, which also contains from 0.5 to 5.0 g/L of surfactant.

6. A bath composition according to claim 3, which also contains from 0.5 to 5.0 g/L of surfactant.

7. A bath composition according to claim 1, which also contains a surfactant.

8. A bath composition according to claim 7, having a pH value from 2 to 4.

9. A process of forming a zinc phosphate conversion coating on a metal substrate, said process comprising a step of contacting the metal substrate with a composition according to claim 8 at a temperature of 25° C. to 50° C.

10. A process of forming a zinc phosphate conversion coating on a metal substrate, said process comprising a step of contacting the metal substrate with a composition according to claim 7 at a temperature of 25° C. to 50° C.

11. A bath composition according to claim 5, having a pH value from 2 to 4.

12. A bath composition according to claim 4, having a pH value from 2 to 4.

13. A process of forming a zinc phosphate conversion coating on a metal substrate, said process comprising a step of contacting the metal substrate with a composition according to claim 12 at a temperature of 25° C. to 50° C.

14. A process of forming a zinc phosphate conversion coating on a metal substrate, said process comprising a step of contacting the metal substrate with a composition according to claim 11 at a temperature of 25° C. to 50° C.

15. A process of forming a zinc phosphate conversion coating on a metal substrate, said process comprising a step of contacting the metal substrate with a composition according to claim 6 at a temperature of 25° C. to 50° C.

16. A process of forming a zinc phosphate conversion coating on a metal substrate, said process comprising a step of contacting the metal substrate with a composition according to claim 5 at a temperature of 25° C. to 50° C.

17. A process of forming a zinc phosphate conversion coating on a metal substrate, said process comprising a step of contacting the metal substrate with a composition according to claim 4 at a temperature of 25° C. to 50° C.

18. A process of forming a zinc phosphate conversion coating on a metal substrate, said process comprising a step of contacting the metal substrate with a composition according to claim 3 a temperature of 25° C. to 50° C.

19. A process of forming a zinc phosphate conversion coating on a metal substrate, said process comprising a step of contacting the metal substrate with a composition according to claim 2 at a temperature of 25° C. to 50° C.

20. A process of forming a zinc phosphate conversion coating on a metal substrate, said process comprising a step of contacting the metal substrate with a composition according to claim 1.

* * * * *

UNITED STATES PATENT AND TRADEMARK OFFICE

CERTIFICATE OF CORRECTION

PATENT NO. : 6,231,688 B1
DATED : May 15, 2001
INVENTOR(S) : Ishii et al.

It is certified that error appears in the above-identified patent and that said Letters Patent is hereby corrected as shown below:

Title page,
Item [75], Inventors, delete “Hiratsuka”, and insert therefor -- Hiratsuka-shi --.

Column 27,
Line 1, after “claim”, insert therefor -- 1 --.

Column 28,
Line 24, after “claim 3”, insert therefor -- at --.

Signed and Sealed this

First Day of July, 2003

JAMES E. ROGAN
*Director of the United States Patent and Trademark Office*